United States Patent [19]

Watanabe et al.

[11] Patent Number: 4,698,037

[45] Date of Patent: Oct. 6, 1987

[54] PROTECTIVE COWLING ARRANGEMENT FOR OUTBOARD MOTOR

[75] Inventors: Eifu Watanabe; Toshiyuki Yamazaki, both of Hamamatsu, Japan

[73] Assignee: Sanshin Kogyo Kabushiki Kaisha, Japan

[21] Appl. No.: 845,596

[22] Filed: Mar. 28, 1986

[30] Foreign Application Priority Data

Apr. 4, 1985 [JP] Japan ..... 60-70042

[51] Int. Cl.[4] ..... B63H 21/00

[52] U.S. Cl. ..... 440/78; 440/76; 123/195 P

[58] Field of Search ..... 440/76–78; 123/195 R, 195 C, 195 P, 195 S, 198 E

[56] References Cited

U.S. PATENT DOCUMENTS

| | | | |
|---|---|---|---|
| 153,704 | 5/1949 | Kiekhaefer | 440/78 |
| 1,890,879 | 12/1932 | Johnson | 440/78 |
| 2,943,592 | 7/1960 | Benson | 440/78 |
| 3,240,180 | 3/1966 | Byrd | 440/78 |
| 3,939,795 | 2/1976 | Rocka | 440/78 |
| 4,348,194 | 9/1982 | Walsh | 440/77 |

*Primary Examiner*—Joseph F. Peters, Jr.
*Assistant Examiner*—Clifford T. Bartz
*Attorney, Agent, or Firm*—Ernest A. Beutler

[57] ABSTRACT

An outboard motor cowling arrangement wherein the cowling includes a tray that is affixed directly to the drive shaft housing independently of the other cowling portions.

7 Claims, 7 Drawing Figures

PROTECTIVE COWLING ARRANGEMENT FOR OUTBOARD MOTOR

BACKGROUND OF THE INVENTION

This invention relates to a protective cowling arrangement for outboard motors and more particularly to an improved, simplified and easy to assemble protective cowling arrangement for outboard motors.

In most outboard motors, the power head, which is supported at the upper end of the drive shaft housing, includes an internal combustion engine which is supported at the upper end of the drive shaft housing and a protective cowling which encircles the engine and the upper portion of the drive shaft housing so as to provide a protective enclosure for the engine and to seal in areas where water might enter into the power head and damage the outboard motor. The protective cowling generally is comprised of a tray which underlies the engine and which is normally attached directly to the drive shaft housing. Affixed to the tray is a main cover portion which overlies and surrounds the major portion of the engine and which is detachably connected and sealed to the tray. In addition, the protective cowling normally includes a skirt which depends from the tray and which surrounds the upper portion of the drive shaft housing and is intended to provide a seal in this lower area to prevent water from traveling upwardly into the tray. With the prior art constructions of this type, the skirt has been attached directly to the tray and in an area adjacent where the engine is supported on the drive shaft housing. As a result, the fasteners which secure the elements relative to each other normally include threaded fasteners which enter into the tray from below and which are encircled by the skirt. This type of arrangement makes assembly quite difficult and also offers considerable problems in connection with the servicing of the engine. As a result, it is difficult to remove the protective cowling assembly during servicing and also to reinstall it.

It is, therefore, a principal object of this invention to provide an improved protective cowling arrangement for an outboard motor.

It is a further object of this invention to provide an improved arrangement for securing the skirt of the protective cowling to the other components.

SUMMARY OF THE INVENTION

This invention is adapted to be embodied in an outboard motor comprised of a drive shaft housing having an outer peripheral surface, an internal combustion engine supported at the upper end of the drive shaft housing and a protective cowling encircling the engine and the upper end of the drive shaft housing. The protective cowling is comprised of a tray portion that is disposed at least in part beneath the engine. An upper cowling portion is fixed to the tray portion and encircles and encloses the engine and sealingly engages the tray portion around its periphery. A skirt portion surrounds the drive shaft housing around its periphery, is affixed directly to the drive shaft housing and is sealingly engaged with the tray portion around its periphery.

DETAILED DESCRIPTION OF THE PREFERRED EMBODIMENTS

Figure 1:
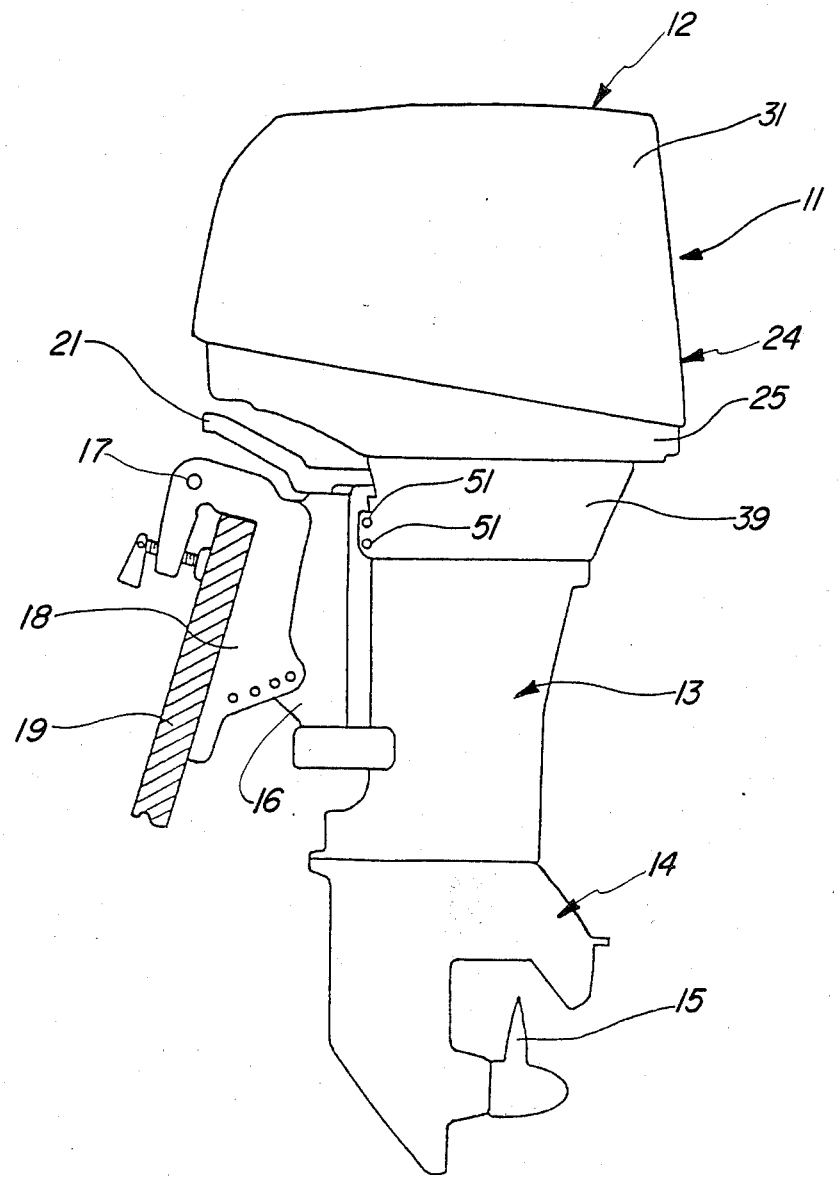
FIG. 1 is a side elevational view of an outboard motor constructed in accordance with an embodiment of the invention.
Figure 2:
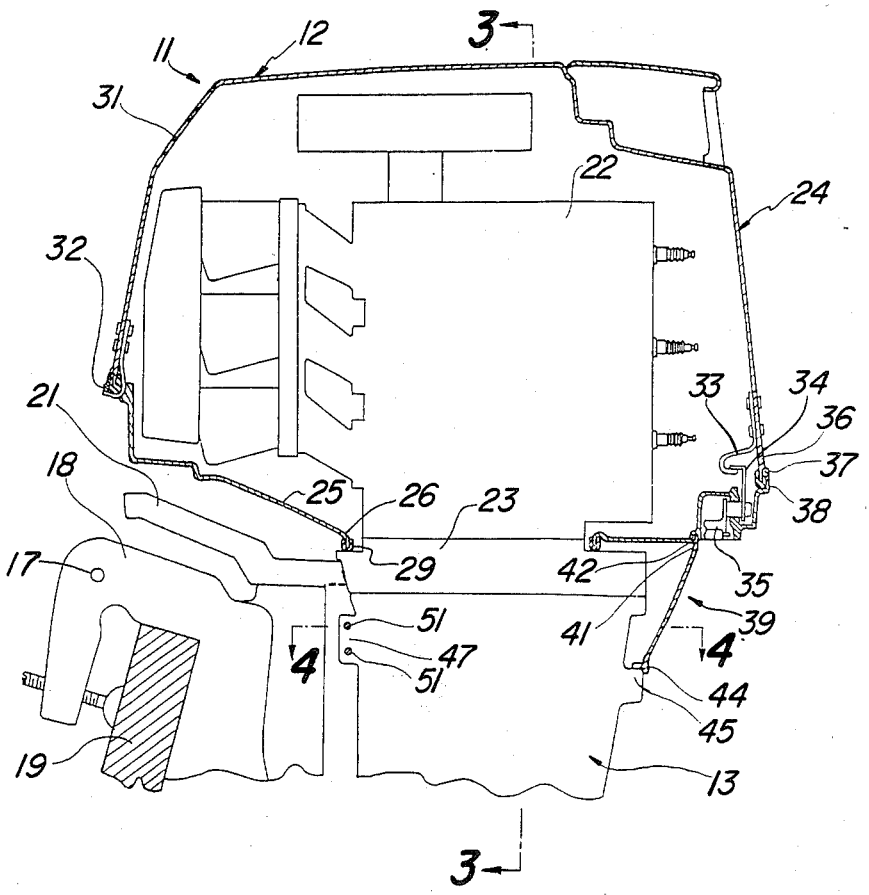
FIG. 2 is an enlarged side elevational view, with a portion shown in section, of the power head and adjacent components of the outboard motor.
Figure 3:
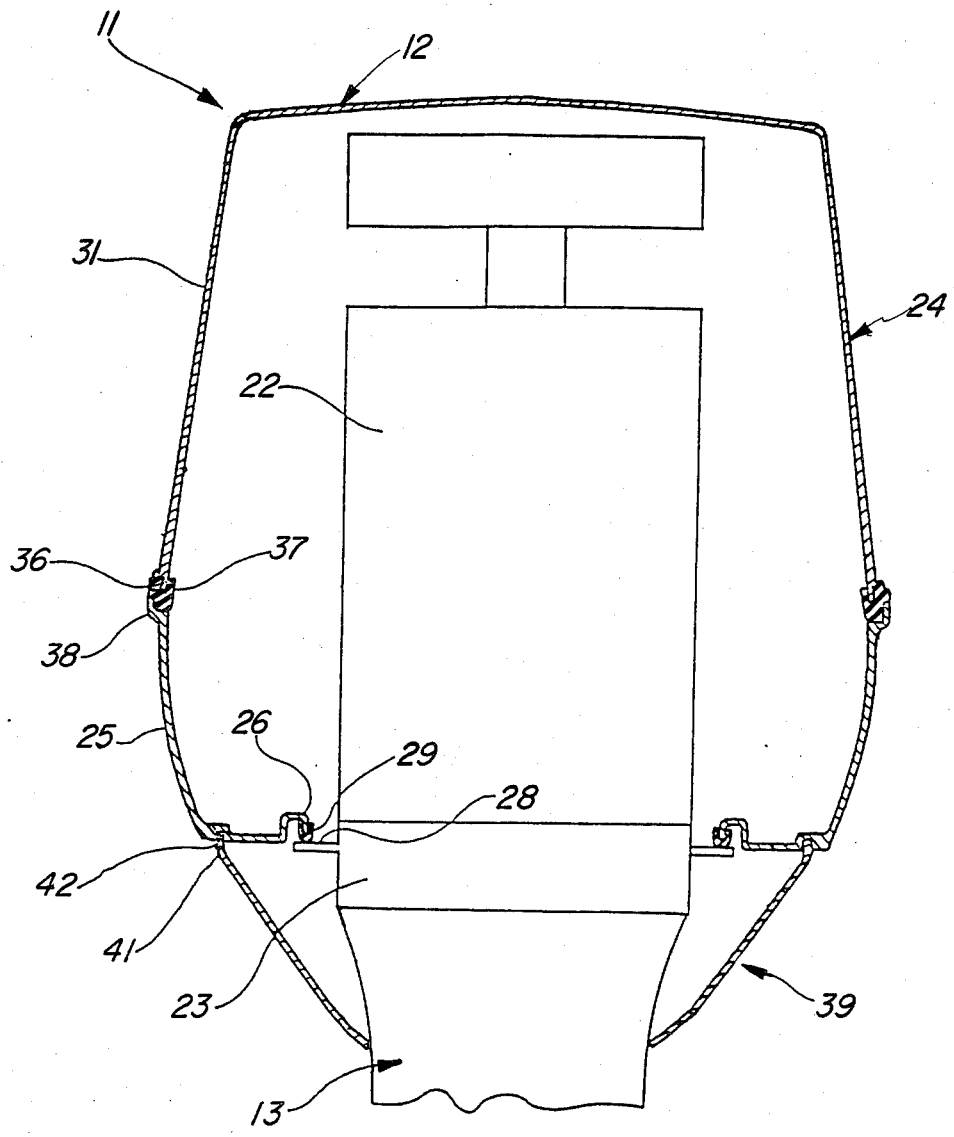
FIG. 3 is a cross-sectional view taken along the line 3—3 of FIG. 2.
Figure 4:
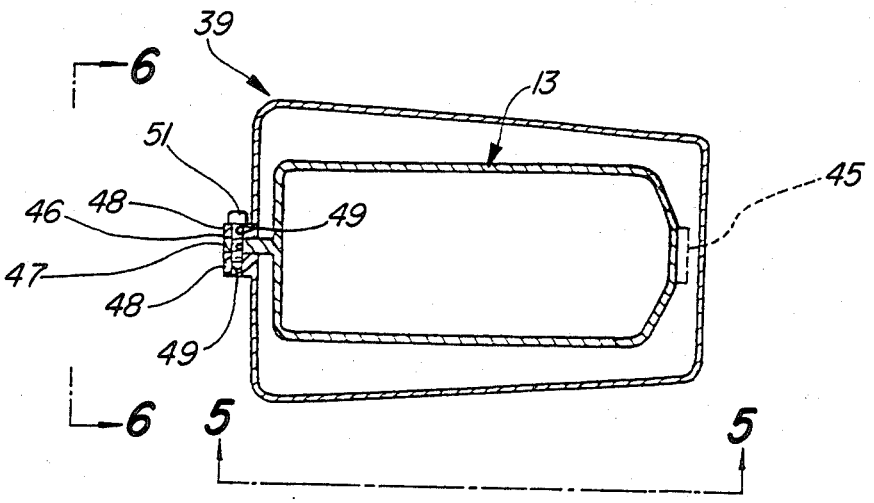
FIG. 4 is a cross-sectional view taken along the line 4—4 of FIG. 2.
Figure 5:
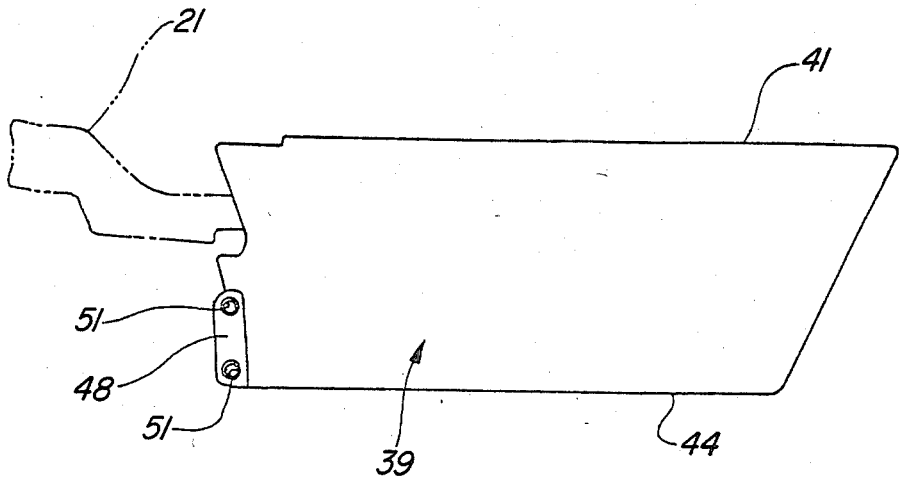
FIG. 5 is a side elevational view looking in the direction of the line 5—5 of FIG. 4.

Referring first to FIG. 1, an outboard motor constructed in accordance with an embodiment of the invention is identified generally by the reference numeral 11. The outboard motor 11 is comprised of a power head assembly, indicated generally by the reference numeral 12, a drive shaft housing, indicated generally by the reference numeral 13, and a lower unit, indicated generally by the reference numeral 14. A propeller 15 is supported by the lower unit 14 and is driven through a transmission (not shown) carried in the lower unit and driven by a drive shaft (not shown) that is rotatably journaled in the drive shaft housing.

The outboard motor and specifically the drive shaft housing 13 is supported for steering movement about a generally vertically extending steering axis by means of a swivel bracket assembly 16. The swivel bracket assembly 16 is, in turn, supported for tilting movement about a horizontally disposed tilt axis by means of a pivot pin 17 and clamping bracket 18. The clamping bracket 18 is, in turn, adapted to be affixed to a transom 19 of an associated watercraft. The steering of the outboard motor 11 is controlled by a tiller 21 that is affixed in a suitable manner to the steering shaft. The construction of the outboard motor 11 as thus far described is conventional and those components which form no part of the invention have been illustrated only generally and will not be described in any further detail.

Referring now to the remaining figures, the power head 12 includes an internal combustion engine, which is identified generally by the reference numeral 22. The construction of the engine 22 is not particularly relevant to the invention. Suffice it to say that the engine 22 drives an output shaft which rotates about a vertically extending axis and which drives the drive shaft that is contained within the drive shaft housing 13 in a known manner. The engine 22 is supported upon a spacer plate 23 that is, in turn, carried at the upper end of the drive shaft housing 13 so as to provide structural support for the engine 22.

The engine 22 and the upper portion of the drive shaft housing 13 including the spacer plate 23 are enclosed within a protective cowling, indicated generally by the reference numeral 24 and which is constructed and attached in accordance with an embodiment of the invention. The protective cowling 24 is comprised of a tray 25 which is formed from a suitable material such as a molded plastic and which has a central opening 26 that surrounds the lower portion of the engine 22 and which is sealingly engaged with an upper surface of a flange 28 formed on the spacer plate 23. For this purpose, an annular seal 29 is carried by a peripheral flange formed on the tray 25 around the opening 26.

The protective cowling 24 further includes an upper or main cowling member 31 which generally encloses the engine 22 and which overlies it. The main cowling portion 31 is detachably connected to the tray 25 by means including a front latch 32 and a rear latching assembly tha includes a hook 33 that is affixed to the rear portion of the upper cowling piece 31. A pivotally supported latch member 34 is carried by the tray 25 and is adapted to engage the hook 33 for holding the upper cowling member 31 onto the tray 25. The latching member 34 is rotated between a released and engaged position by means of an operating handle portion 35 which is journaled on the tray in an appropriate manner.

The upper cowling piece 31 is formed with a peripheral flange 36 that carries a gasket 37 that is held in sealing engagement with a ledge 38 formed on the tray 25 by means of the latching mechanism as aforedescribed. As a result, the tray 25 and upper cowling portion 31 form a generally sealed enclosure for the engine 22. Of course, an air inlet opening is provided in the protective cowling 24 for delivering induction system air to the induction system of the engine in a known manner.

Figure 6:
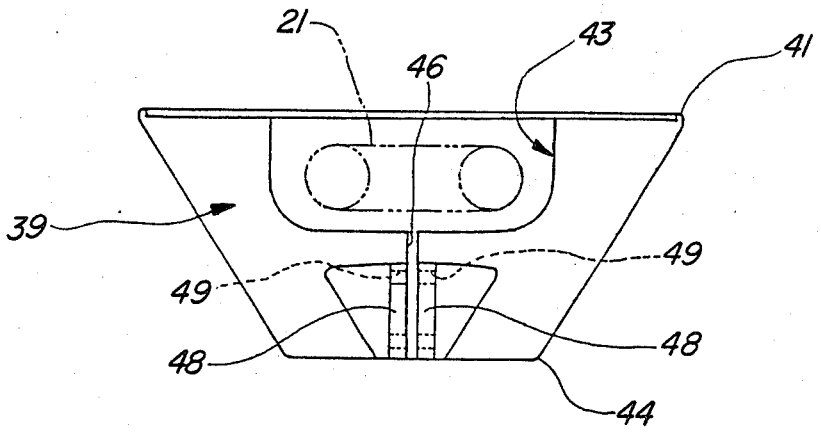
FIG. 6 is a front plan view looking in the direction of the line 6—6 in FIG. 4.

The protective cowling 24 is completed by means of a skirt member, indicated generally by the reference numeral 39. The skirt member 39 serves the function of providing a protective covering for the upper end of the drive shaft housing 13 and plate 23 so as to conceal the attaching devices that support the engine 22 on the plate 23 and also to provide further water sealing. In the embodiment of FIGS. 1 and 6, the skirt 39 is formed of a single piece construction and may be made from either molded plastic such as fiberglass or from a casting such as aluminum. The embodiment of FIGS. 1 through 6 is particularly adapted, however, to be formed from plastic.

To provide a connection to the tray 25, the skirt 39 has an upper peripheral edge 41 which is sealingly engaged in a groove 42 formed in the lower side of the tray 25 generally outwardly from its gasket 29 so as to provide a labyrinth type seal which will assist in preventing water from intruding into the interior of the cowling. At the forward edge, the skirt 39 is provided with an opening 43 that passes the tiller 21.

The skirt 39 also has a lower portion and particularly a lower edge 44 that encircles the adjacent portion of the drive shaft housing 13. If the skirt 39 is formed from plastic, it may directly engage the drive shaft housing. If it is formed from metal, however, there should be some clearance so as to prevent marring of the exterior of the drive shaft housing. The drive shaft housing is provided with a supporting ledge 45 that engages and supports the rear edge of the skirt 39.

The forward edge of the skirt 39 is slit, as at 46 (FIGS. 4 and 6), so as to pass a lug 47 formed on the drive shaft housing 13. This slit is defined by a pair of forwardly extending flanges 48 of the skirt 39 which flanges lie on opposite sides of the lug 47. The flanges 48 are provided with aligned openings 49 that register with corresponding openings in the lug 47 so as to pass threaded fastener assemblies 51 so as to secure the skirt 39 directly to the drive shaft housing 13. With previous constructions of this type, the skirt was affixed to the lower tray and thus there were difficulties presented with assembly and disassembly, as aforenoted. These difficulties are avoided with the present construction.

Figure 7:
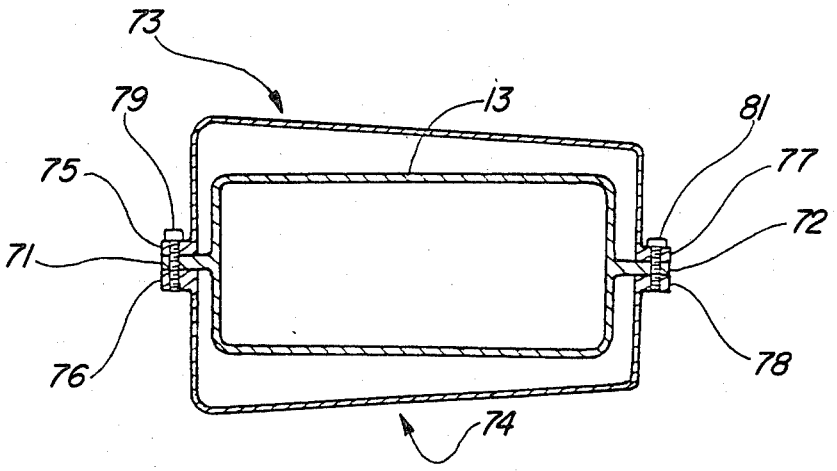
FIG. 7 is a cross-sectional view, in part similar to FIG. 4, showing another embodiment of the invention.

FIG. 7 shows another embodiment of the invention wherein the skirt is designed to be made from aluminum or another light weight metal and hence has a two-piece construction. In this embodiment, only the attachment of the skirt to the drive shaft housing has been illustrated and described since the remaining portions of the assembly may be as that of the previously described embodiment.

In this embodiment, the drive shaft housing 13 is provided with a forwardly facing lug 71 and a rearwardly facing lug 72. The skirt assembly is comprised of a first piece 73 and a second piece 74 each of which have respective forwardly extending flanges 75 and 76 and rearwardly extending flanges 77 and 78. The flanges 75 and 76 overlie the lug 71 while the flanges 77 and 78 overlie the lug 72. Threaded fasteners 79 and 81 extend through the respective flanges and lugs 75, 76, 71 and 77, 78, 72 for securing the skirt directly to the drive shaft housing.

It should be readily apparent from the foregoing description that an improved and simplified protective cowling arrangement for an outboard motor has been illustrated and described wherein the outer cowling includes a skirt which is directly affixed to the drive shaft housing thus simplifying the prior art type of arrangements and facilitating servicing. Although embodiments of the invention have been illustrated and described, various changes and modifications may be made without departing from the spirit and scope of the invention, as defined by the appended claims.

We claim:

1. An outboard motor construction comprising a drive shaft housing having an outer peripheral surface, an internal combustion engine supported by a supporting element at the upper end of said drive shaft housing, and a protective cowling encircling said engine and the upper end of said drive shaft housing, said protective cowling comprising a tray portion disposed at least in part beneath said engine, an upper cowling portion affixed to said tray portion, encircling and enclosing said engine and sealingly engaged with said tray portion around its periphery and a skirt portion surrounding said drive shaft housing around its periphery, affixed directly to said drive shaft housing independently of said tray portion and carrying means sealingly engaged with said tray portion around its periphery, said skirt portion being removable from said drive shaft housing without removal of either of said tray portions or said upper cowling portion.

2. An outboard motor construction as set forth in claim 1 wherein the skirt portion is affixed to the drive shaft housing independently of the tray portion and upper portion.

3. An outboard motor construction as set forth in claim 1 further including a flange formed on the supporting element and which is sealingly engaged by seal means carried by the tray portion.

4. An outboard motor construction as set forth in claim 3 wherein the skirt portion sealingly engages the tray portion outwardly of the seal means carried by the tray portion.

5. An outboard motor construction as set forth in claim 4 wherein the skirt portion is affixed to the drive shaft housing independently of the tray portion and the upper portion.

6. An outboard motor construction as set forth in claim 5 wherein the skirt portion has a pair of outwardly extending flanges engaged with opposite sides of a lug formed on the drive shaft housing and to which lug the flange portions are affixed.

7. An outboard motor construction as set forth in claim 5 wherein the skirt portion comprises a pair of mating members each having respective oppositely facing flanges affixed directly to oppositely facing lugs formed on the drive shaft housing.

* * * * *